US011492693B2

(12) United States Patent
Hunger et al.

(10) Patent No.: US 11,492,693 B2
(45) Date of Patent: Nov. 8, 2022

(54) PRE-TREATMENT PROCESS OF A SURFACE OF A METALLIC SUBSTRATE

(71) Applicant: BorTec GmbH, Hürth (DE)

(72) Inventors: Ralph Hunger, Rheinbach (DE); Andreas Hunger, Brühl (DE); Robin Berger, Engelskrichen (DE)

(73) Assignee: BORTEC GMBH, Hürth (DE)

( * ) Notice: Subject to any disclaimer, the term of this patent is extended or adjusted under 35 U.S.C. 154(b) by 114 days.

(21) Appl. No.: 16/647,323

(22) PCT Filed: Sep. 11, 2018

(86) PCT No.: PCT/EP2018/074461

§ 371 (c)(1),
(2) Date: Mar. 13, 2020

(87) PCT Pub. No.: WO2019/057555

PCT Pub. Date: Mar. 28, 2019

(65) Prior Publication Data

US 2021/0123125 A1 Apr. 29, 2021

(30) Foreign Application Priority Data

Sep. 19, 2017 (EP) ..... 17191877

(51) Int. Cl.

| | |
|---|---|
| ***C23C 8/02*** | (2006.01) |
| ***C23C 8/20*** | (2006.01) |
| ***C23C 8/24*** | (2006.01) |
| ***C23C 8/30*** | (2006.01) |

(52) U.S. Cl.

CPC ..... *C23C 8/02* (2013.01); *C23C 8/20* (2013.01); *C23C 8/24* (2013.01); *C23C 8/30* (2013.01)

(58) Field of Classification Search

CPC .... C23C 8/02; C23C 8/20; C23C 8/24; C23C 8/30

See application file for complete search history.

(56) References Cited

U.S. PATENT DOCUMENTS

| | | | | |
|---|---|---|---|---|
| 2,851,387 | A | 9/1958 | Low | |
| 2012/0111454 | A1* | 5/2012 | Moyer | C22C 38/48 148/207 |

FOREIGN PATENT DOCUMENTS

| | | | |
|---|---|---|---|
| EP | 0209307 | A1 | 1/1987 |
| EP | 0237153 | A1 | 9/1987 |
| EP | 0516899 | A1 | 12/1992 |
| WO | 2006136166 | A1 | 12/2006 |

OTHER PUBLICATIONS

International Search Report dated Oct. 26, 2018 in International Application No. PCT/EP2018/074461.
Written Opinion dated Oct. 26, 2018 in International Application No. PCT/EP2018/074461.

* cited by examiner

*Primary Examiner* — Jessee R Roe
(74) *Attorney, Agent, or Firm* — Panitch Schwarze Belisario & Nadel LLP; Lars H. Genieser

(57) ABSTRACT

Process for pre-treatment of a surface of a chromium containing corrosion resistant metallic substrate prior to further processing, wherein the metallic substrate is brought into contact with an in-situ generated activating agent, being the thermal decomposition product of a hydrofluoroolefin, the substrate and the activating agent are heated, and optionally the activating agent is partly or entirely removed before further processing.

18 Claims, 3 Drawing Sheets

PRE-TREATMENT PROCESS OF A SURFACE OF A METALLIC SUBSTRATE

CROSS-REFERENCE TO RELATED APPLICATIONS

This application is a Section 371 of International Application No. PCT/EP2018/074461, filed Sep. 11, 2018, which was published in the English language on Mar. 28, 2019 as International Publication No. WO 2019/057555 A1, which claims priority under 35 U.S.C. § 119(b) to European Application No. 17191877.4, filed Sep. 19, 2017, each of which are hereby incorporated herein by reference in their entireties.

The present invention is directed to the pre-treatment of surfaces of chromium containing corrosion resistant metallic substrates prior to a further treatment.

Any documents cited in the present specification are incorporated by reference in their entirety in as much as they do not contradict the teaching of the present invention; in the latter case the disclosure of the present invention takes precedence.

Stainless steel is used in a variety of applications. Often, the stainless steel needs to be hardened in order to be suitable for the demands posed by the respective applications. Usually the hardening is done by surface hardening of the stainless steel in heat treatment processes. One of the main problems of these processes, namely nitriding and carburizing or nitrocarburizing, is the fact that the surfaces of stainless steel often form passivating layers on their surface. These passivating layers can partially or entirely prevent the agents used for nitriding or carburizing from entering the surface of the stainless steel, thus effectively preventing the hardening. One example of such a passivating layer is a chromium oxide layer which is formed when stainless steel having a chromium content of about 10 percent by weight or more comes into contact with atmospheric oxygen. In order for the nitriding/carburizing agents, usually carbon or nitrogen, to be able to diffuse into the surface of the stainless steel and be able to form a hardened surface, these passivating layers need to be removed.

In order to remove such passivating layers, the art has developed the step of activation in which the workpiece is for example contacted with a halogen containing gas such as HF, HCl, $NF_3$, $F_2$ or $Cl_2$ at elevated temperatures, for example 200° C. to 400° C. to make the protective oxide coating transparent to carbon atoms. Such an activation step is for example described in WO 2011/017495 A1. In WO 2011/009463 A1 a process for activating such surfaces is described in which a compound containing nitrogen and carbon, that is an amine compound, containing at least four atoms is heated and contacted with the surface of the substrate.

However, the activation or depassivating processes of the prior art still have some disadvantages.

Accordingly, it was desirable and an object of the present invention to find a process for pre-treatment of surfaces of chromium containing corrosion resistant metallic substrates prior to a further processing which uses compounds which are easy to handle and easy to transform into activating species. These processes should also be easy to perform.

These and other objects that become apparent to the person skilled in the art reading the present description have been solved by the processes outlined below as well as those outlined in the claims.

In the context of the present invention any amounts given are amounts by weight, if not specifically mentioned otherwise.

In the context of the present invention atmospheric conditions designate temperatures of about 23° C. and a pressure of about 1013 mbar.

In the context of the present invention temperatures are given in degrees Celsius (° C.), and reactions are conducted at room temperature (23° C.), if not specifically designated otherwise.

In the context of the present invention the process steps are conducted at atmospheric pressure/normal pressure that means about 1013 mbar, if not specifically designated otherwise. Also, pressures given are given as absolute pressures (not gauge), unless otherwise indicated.

In the context of the present invention the formulation "and/or" encloses both any one as well as all combinations of the elements listed in the respective lists.

In the context of the present invention the terms (including their grammatical flexions, respectively) "activating agent" and "depassivating agent" are used interchangeably.

In the context of the present invention the terms (including their grammatical flexions, respectively) "passivating" or "passivated" mean covering/covered with a protective chemical substance, especially a chromium oxide layer.

In the context of the present invention the terms (including their grammatical flexions, respectively) "activation", "depassivating" and "pre-treatment" are used interchangeably.

In the context of the present invention the terms (including their grammatical flexions, respectively) "after-treatment" and "further treatment" are used interchangeably.

In the context of the present invention the term "Hydrofluoroolefin (HFO)" represents unsaturated organic compounds composed of hydrogen, fluorine and carbon, and optionally further atoms, especially halogen.

Accordingly, in the present invention a process has been found for the pre-treatment of surfaces of chromium containing corrosion resistant metallic substrates prior to a further treatment, especially nitriding, carburizing or nitrocarburizing, in which process a) the metallic substrate is brought into contact with a thermal decomposition product of a hydrofluoroolefin,
b) the substrate and the thermal decomposition product are heated,
c) and optionally the remains of the activating agent are partly or entirely removed before further processing.

With the present process of the present invention a way has been found in which the passivated surface of a metallic substrate, which in particular is formed from chromium oxide, can be depassivated/activated and made permeable for the following diffusion of the hardening agents, in particular nitrogen and carbon, into the surface of the metallic substrate.

The metallic substrates that are employable in the process of the present invention can in principle be any metallic substrates on which a passivating surface layer is formed, in particular those containing chromium. In one embodiment the metallic substrates are not based on titanium and/or not titanium.

In one embodiment of the present invention the substrates are selected from the group consisting of steel, nickel based alloys, cobalt based alloys, manganese based alloys and combinations thereof.

In one embodiment of the present invention steels are employable which have a chromium content of about 10 percent by weight or more and are corrosion resistant.

In another embodiment of the present invention steels are employable containing 5 to 50, preferably 10 to 40 percent by weight of nickel, steels containing 10 to 40 percent by weight of nickel and 10 to 35 percent by weight of chromium are employable.

In certain embodiments of the present invention the employable steels/substrates are selected from those according to the following table:

| DIN designation | AISI-standard designation |
|---|---|
| Ferritic stainless steel | |
| 1.4016 | 430 |
| 1.4113 | 434 |
| Martensitic stainless steel | |
| 1.4006 | 410 |
| 1.4021/1.4034 | 420 |
| 1.4057 | 431 |
| Austenitic stainless steel | |
| 1.4301 | 304 |
| 1.4303 | 305 |
| 1.4306 | 304L |
| 1.4305 | 303 |
| 1.4310 | 301 |
| 1.4401 | 316 |
| 1.4404/1.4435 | 316L |
| 1.4539 | 904L |
| 1.4571 | 316Ti |
| 1.4841 | 310S |
| Duplex stainless steel | |
| 1.4362 | S32304 |
| 1.4462 | 318L/S32205 |
| 1.4462 | S32760 |
| Martensitic, precipitation hardening stainless steel | |
| 1.4542 | 630 |
| 1.4545 | UNS S15500 |
| 1.4548 | UNS S13800 |
| Cobalt chromium alloy | |
| MP35N Co—28Cr—6Mo (high Carbon) Biodur CCM Plus ® Alloy | |
| Nickel-based alloy | |
| 2.4668 | UNS N07718 |
| 2.4856 | UNS N06625 |
| 2.4816 | UNS N06600 |
| 2.4858 | UNS N08825 |
| 2.4819 | UNS N10276 |

The present invention is not restricted to those substrates; further/other substrates may be employed.

In certain embodiments of the present invention the substrate is selected from the group consisting of those based on austenite, particularly austenite (1.4301) or austenite (1.4404), those based on Inconel 718 (2.4668), those based on martensite (1.4057) and alloys of these.

In some embodiments of the present invention preferred metallic substrates to be pre-treated are stainless steel(s), substrates based on nickel base alloys and substrates based on cobalt base alloys.

Titanium and titanium based substrates are not preferred and in some embodiments of the present invention excluded from the metallic substrates to be pre-treated.

In the present invention the thermal decomposition product of one or a mixture of more than one hydrofluoroolefins (HFOs) is to be understood as an activating agent for the surface of the substrate.

In some embodiments the thermal decomposition product is the thermal decomposition product of tetrafluorpropylene (tetrafluoropropene), which may have one or two of its fluorine-atoms substituted by chlorine-atoms, preferably selected form the group consisting of 2,3,3,3-tetrafluoropropene, 1,3,3,3-tetrafluoropropene, 1-chloro-3,3,3-trifluoropropene and mixtures thereof, even more preferably 2,3,3,3-tetrafluoropropene, 1,3,3,3-tetrafluoropropene and most preferably 2,3,3,3-tetrafluoropropene.

In some embodiments of the present invention the HFOs can also contain one or more chlorine-atoms.

In some embodiments of the present invention useable HFOs include 2,3,3,3-tetrafluoropropene (HFO-1234yf) and 1,3,3,3-tetrafluoropropene (HFO-1234ze). 1-chloro-3,3,3-trifluoropropene (HFO-1233zd).

In some embodiments of the present invention the thermal dec position product comprises HF and, optionally, carbonylfluoride ($COF_2$).

According to the invention, the hydrofluoroolefin is brought at a temperature where the compound brakes into smaller structures or even atoms. These thermal decomposition products are applied without purification to the substrate. Preferably, the decomposition product is thus produced shortly before bringing it into contact with the metallic substrate. Thus, it could be considered to be in-situ.

In contrast to methods that use HF for the pretreatment of the surface the handling of hydrofluoroolefins is much safer. Typically, hydrofluoroolefins are neither toxic or corrosive whereas leakage of HF is highly dangerous.

In certain embodiments of the present invention the heating in step b) is achieved by residual heat of the thermal decomposition product.

In certain embodiments of the present invention the substrate is pre-heated prior to contacting with the thermal decomposition product, preferably to a temperature of between 150° C. and 250° C.

In certain embodiments of the present invention the thermal decomposition process comprises the steps of Ia) evacuating a decomposition reactor to below 0.5 bar atmospheric pressure, preferably 0.1 bar or less, more preferably below 0.1 bar, then flushing the reactor with inert gas;

or

Ib) flushing the decomposition reactor with inert gas without prior evacuation;

II) supplying a hydrofluoroolefin into the decomposition reactor either neat or together with an inert gas;

III) raising the temperature in the reactor to decomposition temperature.

In certain embodiments of the present invention, in steps II) and III) an atmosphere is provided wherein the oxygen concentration is below the ignition limit, preferably an oxygen free atmosphere is provided, more preferably the atmosphere is an inert gas or a mixture of inert gases.

In certain embodiments the heating is achieved by convection, particularly by electrical heating of the decomposition reactor or specific parts of the decomposition reactor.

In certain embodiments of the present invention the thermal decomposition can be aided by additional application of a plasma, preferably a microwave plasma.

In some embodiments of the present invention it is also possible that the decomposition proceeds by application of a plasma and/or microwave radiation, preferably a microwave plasma, instead of thermal decomposition.

In certain embodiments of the present invention the decomposition proceeds with or without the addition of a decomposition catalyst, preferably without.

In certain embodiments of the present invention the inert gas is selected from the group consisting of noble gas, nitrogen, hydrogen, ammonia, carbon dioxide and mixtures thereof, preferably selected from the group consisting of helium, neon, argon, nitrogen, hydrogen and mixtures thereof, in particular selected from argon, hydrogen, and nitrogen.

In certain embodiments of the present invention the decomposition reactor is an oven or a tube and in particular the decomposition reactor is made of metal and/or ceramic, preferably metal. In some of these embodiments the decomposition reactor has one or more valves that can separate the reactor from the hydrofluoroolefin-intake, the inert gas-intake (if applicable) and the oven in which the substrate is positioned.

In certain embodiments of the present invention the decomposition temperature is between 400 to 1200° C., preferably 800-1000° C.

In certain embodiments the decomposition reactor is free of oxygen, wherein free of oxygen means that the residual amount of oxygen in the decomposition reactor is below the ignition level of the gas mixture.

In this context it should be noted that the oven into which the substrate is placed does not need to be free of oxygen when the substrate is contacted with the activating agent, because it is cooler than the decomposition oven; however in most embodiments the oven is free of oxygen or the oxygen content is reduced, particularly due to the introduction of the activating agent.

Certain embodiments of the present invention are directed to the use of thermal decomposition products of hydrofluoroolefins for pre-treatment of surfaces of chromium containing corrosion resistant metallic substrates prior to further processing, wherein the further processing preferably is a coating process or a diffusion treatment, preferably a nitriding, carburizing or nitrocarburizing process.

In one embodiment of the present invention the surface to be activated is contacted with a gaseous mixture containing the decomposition products of one or more hydrofluoroolefins which then activates the surface by which the passivating layer, which in some particular instances can be a chromium oxide surface layer, becomes permeable for diffusible elements.

Another embodiment according to the present invention involves placing an HFO, which can in some particular instances be 2,3,3,3-tetrafluoropropene, in a decomposition reactor, which in some embodiments can be a heatable metallic tube, heating to 800-1100° C. to form a decomposition product, then flowing the decomposition product together with inert gas or neat into the reaction zone of an oven in which the metallic substrate to be activated is placed, and circulating the activating gaseous mixture for a time between 5 minutes and 240 minutes.

In some embodiments of the present invention it is sufficient to contact the substrate with the activating agent/decomposition product of HFO, in particular together with an inert gas, at room temperature and under atmospheric pressure. Usually the only temperature intake above room temperature results from residual heat from the decomposition step of the HFO.

In certain embodiments of the present invention the amount of hydrofluoroolefin and optionally inert gas that is flowed into the oven is at least twice, or at least three times, or at least four times, or at least five times the volume of the oven space. The amount of inert gas and hydrofluoroolefin gas is measured by a mass flow meter. The total amount of gas at 1013 mbar is used to calculate the relative amount of gas to the volume of the oven space.

While it is possible to use only a hydrofluoroolefin gas, typically a mixture of a hydrofluoroolefin gas and an inert gas is used. In this mixture, the hydrofluoroolefin gas can be between 1 to 95 Vol.-%, typically 5 to 20 Vol.-%.

It is possible to lower the activation temperature by decreasing the pressure during the heating, for example to below about 100 kPa (1.000 mbar), in one particular embodiment to a pressure of between about 1 kPa (10 mbar) and about 80 kPa (800 mbar).

The surfaces so activated/depassivated are then suitable for a following further treatment, for example coating or diffusion processes to, for example, harden the surface and increase the wear resistance of the substrate.

In one embodiment of the present invention the process comprises the following steps:

1. Placing of the substrate parts in a gas-tight oven.
2. Thermally decomposing HFO to form a decomposition product.
3. Flowing the decomposition product, particularly together with inert gas onto the substrate parts and circulating the atmosphere for 15 minutes to 5 hours.
4. Evacuating the oven to below 100 Pa (0.1 mbar) to remove the activating gas mixture containing the decomposition product.
5. Heating of the substrate parts to processing temperature and conducting a nitriding, carburizing or nitro carburizing process as known in the art.
6. Cooling to ambient temperature of about 23° C. after completion of the nitriding, carburizing or nitro carburizing process.

In the present invention there are several possibilities to bring the substrate into contact with the activating agent, the easiest of which is flowing the activating agent over the substrate.

Of course, any other considerable way to apply the activating agent onto the substrate surface is also encompassed in the present invention.

In one embodiment of the present invention, the activation step/pre-treatment is conducted for a time of about 15 minutes to about 240 minutes, particularly 30 minutes to 120 minutes or 55 to about 240 minutes. In some embodiments the temperature is increased to an elevated activation temperature and then the workpiece is held at that temperature.

Before the after-treatment/further treatment the activating agent is removed, particularly entirely removed, wherein "entirely removed" means that the remainder of the activating agent on the activated surface and/or the oven space is below the detection level.

In the context of the present invention the after-treatment can in certain embodiments comprise a nitriding step, a carburizing step or a nitrocarburizing step.

In certain embodiments of the present invention the nitriding step is performed as a gaseous nitriding. In other embodiments of the present invention the nitriding step is performed as a plasma nitriding.

In the context of the present invention, the nitriding step can be performed at atmospheric, increased or decreased pressure. In some embodiments the temperatures employed are around about 330 to about 480° C. However, in some embodiments of the present invention, the nitriding can be conducted with parameters that are usually employed in the art and are known to the person skilled in the art.

In further embodiments of the present invention carburizing can be performed at atmospheric conditions, increased or decreased pressure. In certain embodiments of the present invention the carburization can be performed at temperatures of between about 330° C. and about 560° C., usually between about 380° C. and about 510° C., preferably between about 390° C. and about 500° C. In certain embodiments of the present invention the carburization can be performed for about 5 to about 75 hours, particularly between about 10 and about 50 hours. In some embodiments of the present invention, the carburizing gas comprises from about 90 to about 99% by volume of hydrogen and from about 1 to about 10% by volume of acetylene or CO, preferably from about 94 to about 99% by volume of hydrogen and from about 1 to about 6% by volume of acetylene or CO in one particular embodiment selected from either a mixture of about 98% by volume of hydrogen with about 2% by volume of acetylene or CO, or a mixture of about 95% by volume of hydrogen with about 5% by volume of acetylene or CO.

In the present invention for the carburizing step can be used any of the carburizing gases usually employed in the art. Particularly, the carburizing gas can be selected from the group consisting of acetylene, acetylene analogues, including hydrocarbons with ethylenic unsaturation and hydrocarbons with aromatic unsaturation, ethylene ($C_2H_4$), propylene, butylene, butadiene, propyne ($C_3H_4$) and mixtures thereof. Additionally, it is possible to add a further gas which is able to react with residual oxygen under the reaction conditions encountered during the carburization reaction in the carburization step, in which the additional gas is not an unsaturated hydrocarbon. While the present invention is not limited to these, gaseous aides that can be used in this context are particularly those selected from the group consisting of hydrogen, natural gas, propane, $C_1$-$C_6$ alkanes and other saturated hydrocarbons and mixtures thereof. In some embodiments of the present invention, hydrogen is preferred. Additionally, during carburization it is possible in some embodiments of the present invention to also supply suitable inert diluent gases such as those selected from the group consisting of nitrogen, argon and the like, particularly nitrogen and/or argon. In some embodiments of the present invention, the carburizing is conducted with parameters that are usually employed in the art and are known to the person skilled in the art.

In a particular embodiment of the present invention, the carburizing conditions are between about 450° C. and about 490° C. for about 11 and about 17 hours and a carburizing gas comprising about 98% by volume of hydrogen and about 2% by volume of acetylene or about 95% by volume of hydrogen and about 5% by volume of acetylene.

In embodiments of the present invention a nitrocarburizing step can be employed with the addition of a source of nitrogen, preferably ammonia, to the atmosphere used in the carburizing step. The process temperatures for nitrocarburizing can range between 380-460° C. However, in some embodiments of the present invention, the nitrocarburizing is conducted with parameters that are usually employed in the art and are known to the person skilled in the art.

In one embodiment the decomposition reactor is attached to a conventional oven, and in some embodiments separated from the oven space by a valve.

In a further embodiment the present invention is directed to an apparatus for treating the surface of a chromium containing corrosion resistant metallic substrate by first activating the substrate with a thermal decomposition product of a hydrofluoroolefin and a following nitriding, carburizing or nitrocarburizing process, the apparatus comprising i) a decomposition reactor attached to a substrate treatment oven either directly or interrupted by a valve;
ii) at least one fluoroolefin storage tank and at least one inert gas storage tank connected to the decomposition reactor via valves;
iii) optionally a pressure relief valve; and
iv) an off-gas cleaning unit.

In certain embodiments the decomposition reactor is a convection oven being electrically heated. In further embodiments the decomposition reactor can additionally comprise a plasma generator and/or a microwave generator.

In certain embodiments the substrate treatment oven is a convection oven being electrically heated.

In certain embodiments the decomposition reactor is made of heat resistant materials like metal, e.g. like nickel base alloys or steel, or ceramic.

In certain embodiments the apparatus comprises one or two inert gas storage tanks.

In certain embodiments the apparatus comprises one fluoroolefin storage tank.

In certain embodiments the storage tanks are conventional gas bottles.

In certain embodiments the off gas cleaning unit can be an acid washer, particularly one based on calcium carbonate.

In certain embodiments the apparatus comprises a pressure relief valve. This is particularly the case if the substrate treatment is performed at overpressure. It is, however, also possible to incorporate a pressure relief valve in the apparatus even if operation is not intended to encompass overpressure. A slight overpressure of e.g. 1050 mbar can for example be employed, but also higher overpressures are possible.

An apparatus suitable for performing the present invention is represented by FIG. 5.

Some particular embodiments of the process of the present invention are:

I. A process for pre-treatment of a surface of a chromium containing corrosion resistant metallic substrate prior to further processing, wherein
   a) the metallic substrate is brought into contact with a thermal decomposition product of a thermal decomposition process of a hydrofluoroolefin,
   b) the substrate and the thermal decomposition product are heated,
   c) and optionally the remains of the activating agent are partly or entirely removed before further processing, particularly this is done.

II. The process according to embodiment I, wherein the thermal decomposition product is the thermal decomposition product of tetrafluorpropylene, which may have one or two of its fluorine-atoms substituted by chlorine-atoms, preferably selected form the group consisting of 2,3,3,3-tetrafluoropropene, 1,3,3,3-tetrafluoropropene, 1-chloro-3,3,3-trifluoropropene and mixtures thereof, even more preferably 2,3,3,3-tetrafluoropropene, 1,3,3,3-tetrafluoropropene and most preferably 2,3,3,3-tetrafluoropropene.

III. The process according to embodiment I or II, wherein the heating in step b) is achieved by residual heat of the thermal decomposition product, IV. The process according to any one of embodiments I to III, wherein the substrate is pre-heated prior to contacting with the thermal decomposition product, preferably to a temperature of between 150° C. and 250° C.

V. The process according to any one of embodiments I to IV, wherein the thermal decomposition is a process comprising the steps of, preferably in that order,
   Ia) evacuating a decomposition reactor to below 50 kPa (0.5 bar) atmospheric pressure, preferably 10 kPa (0.1 bar) or less, more preferably below 10 kPa (0.1 bar), then flushing the reactor with inert gas;

or

Ib) flushing the reactor with inert gas without prior evacuation;

II) supplying a hydrofluoroolefin into the decomposition reactor either neat or together with an inert gas;

III) raising the temperature in the reactor to decomposition temperature,

VI. The process according to embodiment V, wherein the inert gas is selected from the group consisting of noble gas, nitrogen, hydrogen, ammonia, carbon dioxide and mixtures thereof, preferably selected from the group consisting of helium, neon, argon, nitrogen, hydrogen and mixtures thereof, particularly preferably selected from argon, nitrogen and mixtures thereof.

VII. The process according to embodiment V or VI, wherein the decomposition reactor is an oven or a tube and wherein the decomposition reactor is a made of metal and/or ceramic, preferably metal.

VIII. The process according to any one of embodiments V to VII, wherein the decomposition temperature is between 400 to 1200° C., preferably 800-1000° C.

IX. The process according to any one of the preceding embodiments, wherein the substrate is selected from the group consisting of martensite, austenite, duplex steel, ferrite, precipitation hardening steel, nickel-based alloys, cobalt-chromium alloys having at least 10% of solved chromium or alloys of these materials as well as mixed material workpieces.

X. The process according to any one of the preceding embodiments, wherein the further processing is a coating process or a diffusion coating, preferably a nitriding, carburizing or nitrocarburizing process.

XI. The process according to any one of the preceding embodiments, wherein the holding temperature for the activating step/pre-treatment is in the range of about 150° C. to about 500° C., preferably about 200° C. to below 400° C.

XII. The process according to any one of the preceding embodiments, wherein the pre-treatment is conducted during between about 5 minutes and about 3 hours, preferably about 30 minutes to about 2 hours.

XIII. The process according to any one of the preceding embodiments, wherein the activating step/pre-treatment is conducted under atmospheric pressure.

XIV. An activated chromium containing corrosion resistant metallic substrate characterized in that the activation is the result of a pre-treatment process according to any one of the preceding embodiments.

XV. An hardened chromium containing corrosion resistant metallic substrate characterized in that the hardening is the result of a nitriding, carburization and/or nitrocarburizing process preceded by the pre-treatment according to any one of embodiments I to XIII.

XVI. Use of thermal decomposition products of hydrofluoroolefins for pre-treatment of a surface of a chromium containing corrosion resistant metallic substrate prior to further processing, wherein the further processing preferably is a coating process or a diffusion coating, preferably a nitriding, carburizing or nitrocarburizing process.

XVII. An apparatus for treating the surface of a chromium containing corrosion resistant metallic substrate by first activating the substrate with a thermal decomposition product of a hydrofluoroolefin and a following nitriding, carburizing or nitrocarburizing process, the apparatus comprising i) a decomposition reactor 1 attached to a substrate treatment oven 4 either directly or interrupted by a valve 7;

ii) at least one fluoroolefin storage tank 2 and at least one inert gas storage tank 3 connected to the decomposition reactor 1 via valves;

iii) optionally a pressure relief valve 8; and iv) an off-gas cleaning unit 6 (FIG. 5).

One specific embodiment of the present invention is a process for the pre-treatment of surfaces of chromium containing corrosion resistant metallic substrates prior to a further treatment, especially nitriding, carburizing or nitrocarburizing, in which process a1) the metallic substrate is placed in an oven and subsequently the oven is evacuated to pressures below 150 Pa (1.5 mbar), preferably below 100 Pa (1 mbar) and then flooded with an inert gas, preferably selected from nitrogen, argon or mixtures thereof, a2) the metallic substrate is then pre-heated in an oven to a temperature of 150° C. to 400° C., preferably 180° C. to 320° C., optionally after reducing the pressure to about 80 to 100 kPa (800 to 1000 mbar)

a3) the thermal decomposition product is introduced into the oven in which the metallic, substrate was placed, either continuously from the decomposition reactor or batchwise, a4) the metallic substrate is brought into contact with the thermal decomposition product, b) the substrate and the thermal decomposition product are heated by residual temperature of the thermal decomposition product and optionally additional heating of the oven, and the gaseous mixture of thermal decomposition product and inert gas is circulated in the oven for between 15 minutes to 150 minutes, c) after that the remains of the activating agent are partly or entirely removed before further processing, by evacuating to pressures below 150 Pa (1.5 mbar), preferably below 100 Pa (1 mbar) and then flooding with an inert gas, preferably selected from nitrogen, argon or mixtures thereof, until a pressure of 95 kPa (950 mbar) is reached, wherein the substrate is preferably selected from metallic substrates based on austenite, martensite or nickel-based alloy, and wherein the thermal decomposition product is the product of a thermal decomposition of a hydrofluoroolefin selected form the group consisting of 2,3,3,3-tetrafluoropropene, 1,3,3,3-tetrafluoropropene, 1-chloro-3,3,3-trifluoropropene and mixtures thereof, preferably 2,3,3,3-tetrafluorpropene, and wherein the amount of activating gas, being either the thermal decomposition product alone or a mixture of the thermal decomposition product and inert gas, introduced into the oven in which the metallic substrate was placed is at least twice the volume of the oven space, and wherein the thermal decomposition process comprises the steps of, in that order, Ia) evacuating a decomposition reactor of a metallic heat-resistant tube to below 50 kPa atmospheric pressure, preferably 10 kPa or less, more preferably below 10 kPa, then flushing the reactor with inert gas;

or

Ib) flushing the reactor with inert gas without prior evacuation;

II) supplying the HFO or HFO mixture into the decomposition reactor either neat or together with an inert gas;

III) raising the temperature in the reactor to decomposition temperature of between 800° C. and 1000° C.

After that further processing is conducted, in one specific embodiment by at first heating the substrate to a temperature of between 350 and 500° C., and then gassing the substrate with i) a mixture of hydrogen and ethylene, for example 98 vol.-% $H_2$ and 2 vol. % $C_2H_2$, or)

ii) a mixture of ammonia, hydrogen and ethylene, for example 75 vol.-% $NH_3$, 20 vol.-% $H_2$ and 5 vol.-% $C_2H_2$, or 80 vol.-% $NH_3$, 18 vol.-% $H_2$ and 2 vol.-% $C_2H_2$, or iii) a mixture of ammonia and carbon dioxide, for example 95 vol.-% $NH_3$, and 5 vol.-% $CO_2$, for a time of between 10 hours and 48 hours, preferably 15 hours and 40 hours and at a temperature between 350° C. and 550° C., preferably 280° C. to 500° C.;

and then cooling the substrate to room temperature under inert atmosphere, the inert atmosphere preferably consisting of nitrogen, argon or mixtures thereof, to provide a hardened substrate; this specific embodiment, however, is not bound to the specific embodiment outlined directly above it.

One particular advantage of the present invention is that with the specific activating agent, being the thermal decomposition product of a hydrofluoroolefin, substrate surfaces are achievable which are particularly even due to a more even etching of the surface than for example with hydrogen chloride.

A further particular advantage of the present invention is that with the specific activating agent pitting corrosion on the substrate can be reduced or even entirely avoided, which can be a problem if ammonium chloride or hydrogen chloride are used.

The various embodiments of the present invention, for example, but not limited to those of the different claims and examples can be combined in any suitable manner.

In the enclosed figures the following is illustrated:

In FIG. 5 certain parts are represented by the following numbers:

Figure 1:
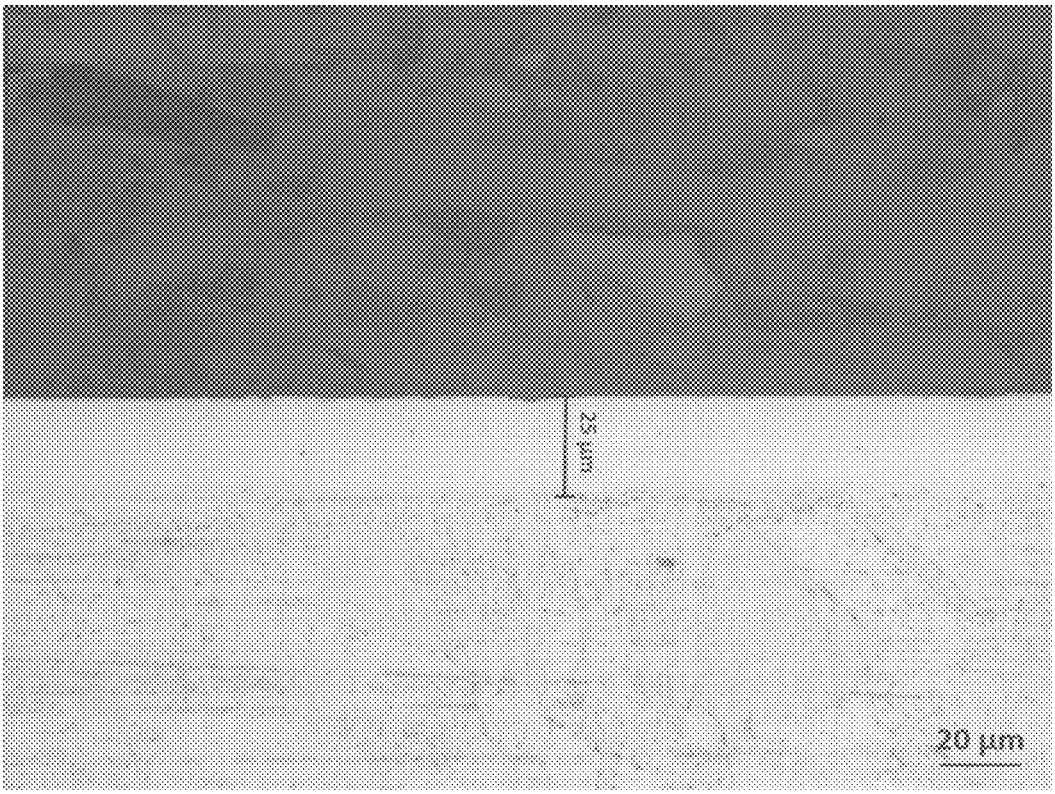
FIG. 1 shows a photograph of a border area of an activated and carburized sample made from a steel based on austenite (1.4301) and activated by the process of the present invention.

1 decomposition reactor
2 fluoroolefin storage tank (e.g. gas bottle)
3 inert gas storage tank (e.g. gas bottle)
4 substrate treatment oven
5 metal substrate
6 off-gas cleaning unit (e.g. acid washer based on calcium carbonate)
7 valves
8 pressure relief valve The present invention will now be explained further by the following non-limiting examples.

EXAMPLES

Example 1

A sample substrate based on austenite (1.4301) was placed in an oven and subsequently, in order to remove oxygen, the oven was evacuated to below 100 Pa (1 mbar) and then flooded with an inert gas (nitrogen). After that the specimen was heated to 200° C. by convection.

In a decomposition reactor (a heatable, metallic heat-resistant tube) attached to the oven 15 vol.-% 2,3,3,3-tetrafluorpropene was cleaved at 850° C. and the decomposition products were introduced into the oven with the aid of 85 vol.-% nitrogen as a carrier gas and circulated for one hour. The amount of 2,3,3,3-tetrafluorpropene and carrier gas introduced into the decomposition reactor was more than twice the volume of the oven space (calculated at 1013 mbar). After one hour the inflow of the activating gas was ceased and the oven space was again evacuated to below 100 Pa (1 mbar).

After that the oven was flooded with nitrogen as inert gas until 95 kPa (950 mbar) were reached and the sample was heated to 480° C. by convection.

The sample was then gassed with a mixture of 98 vol.-% $H_2$ and 2 vol.-% $C_2H_2$ for 20 hours at a temperature of 480° C.

After cooling to room temperature under inert atmosphere (nitrogen) the sample was colored black. The surface hardness according to Vickers (DIN EN ISO 6507) of the sample was measured to be 1.023 HV0.025 and the carburizing layer thickness in the microsection to be 25 μm (the hardness of the substrate before treatment was 205 HV0.025).

The resulting sample was photographed and is shown in FIG. 1, from which it is obvious that a very even, hardened layer on the outside of the material was formed.

Example 2

A sample substrate based on austenite (1.4404) was placed in an oven and subsequently, in order to remove oxygen, the oven was evacuated to below 100 Pa (1 mbar) and then flooded with an inert gas (argon). After that the specimen was heated to 300° C. by convection.

In a decomposition reactor (a heatable, metallic heat-resistant tube) attached to the oven 10 vol-% 2,3,3,3-tetrafluorpropene was cleaved at 900° C. and the decomposition products were introduced into the oven with the aid of 90 vol.-% nitrogen as a carrier gas and circulated for 30 minutes. The amount of 2,3,3,3-tetrafluorpropene and inert gas introduced into the decomposition reactor was more than four times the volume of the oven space (calculated at 1013 mbar). After 30 minutes the inflow of the activating gas was ceased and the oven space was again evacuated to below 100 Pa (1 mbar).

After that the oven was flooded with nitrogen as inert gas until 95 kPa (950 mbar) were reached and the sample was heated to 400° C.

The sample was then gassed with a mixture of 75 vol.-% $NH_3$, 20 vol.-% $H_2$ and 5 vol.-% $C_2H_2$ for 18 hours at a temperature of 400° C.

After cooling to room temperature under inert atmosphere (nitrogen) the sample was colored grey. The surface hardness according to Vickers of the sample was measured to be 1150 HV0.025 and the nitrocarburizing layer thickness in the microsection to be 11 μm (the hardness of the substrate before treatment was 215 HV0.025).

Figure 2:
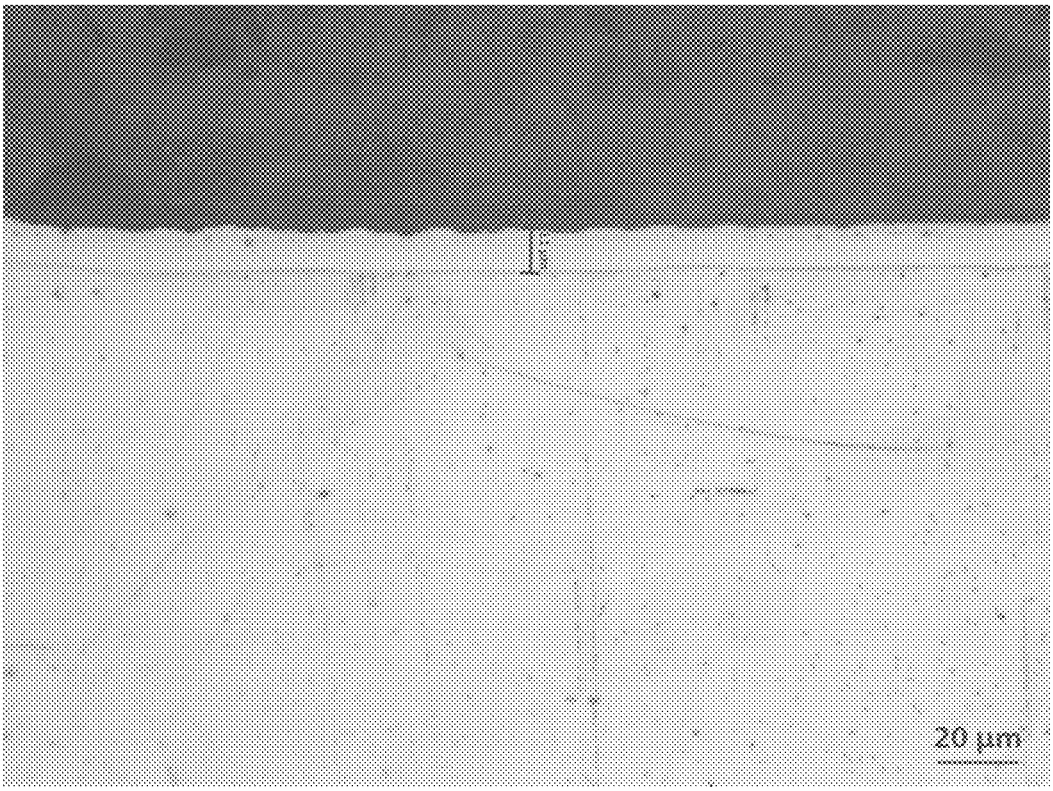
FIG. 2 shows a photograph of a border area of an activated and nitrocarburized sample made from a steel based on austenite (1.4404) and activated by the process of the present invention.

The resulting sample was photographed and is shown in FIG. 2, from which it is obvious that an even, hardened layer on the outside of the material was formed.

Example 3

A sample substrate based on Inconel 718 (2.4668) was placed in an oven and subsequently, in order to remove oxygen, the oven was evacuated to below 100 Pa (1 mbar) and then flooded with an inert gas (argon). After that the specimen was heated to 300° C. by convection at 85 kPa (850 mbar).

In a decomposition reactor (a heatable, metallic heat-resistant tube) attached to the oven 5 vol.-% 2,3,3,3-tetrafluorpropene was cleaved at 950° C. and the decomposition products were introduced into the oven with the aid of 95 vol.-% argon as a carrier gas and circulated for 2 hours. The amount of 2,3,3,3-tetrafluorpropene and carrier gas introduced into the decomposition reactor was more than five times the volume of the oven space (calculated at 1013 mbar). After 2 hours the inflow of the activating gas was ceased and the oven space was again evacuated to below 100 Pa (1 mbar).

After that the oven was flooded with argon as inert gas until 95 kPa (950 mbar) were reached and the sample was heated to 480° C.

The sample was then gassed with a mixture of 80 vol.-% $NH_3$, 18 vol.-% $H_2$ and 2 vol.-% $C_2H_2$ for 36 hours at a temperature of 480° C.

After cooling to room temperature under inert atmosphere (argon) the surface hardness according to Vickers of the sample was measured to be 1070 HV0.025 and the nitrocarburizing layer thickness in the microsection to be 26 μm (the hardness of the substrate before treatment was 362 HV0.025).

Figure 3:
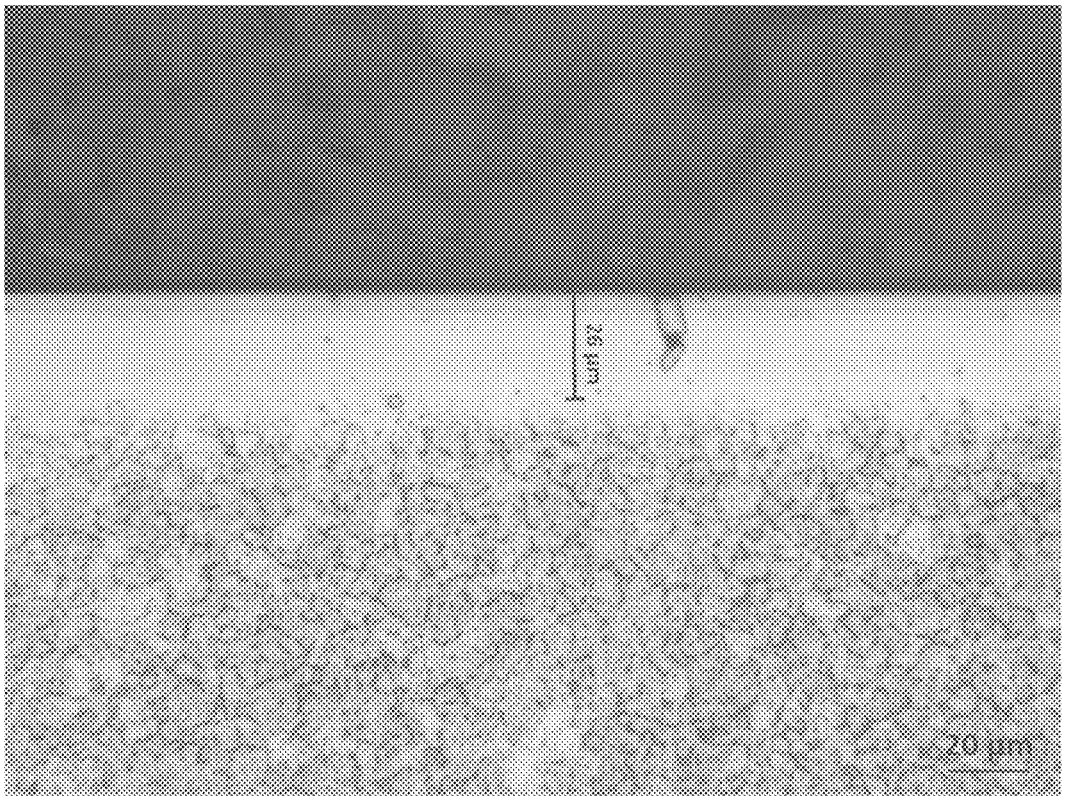
FIG. 3 is a further photograph of a border area of an activated and nitrocarburized sample made from nickel-based material Inconel 718 (2.4668) and activated by the process of the present invention.

The resulting sample was photographed and is shown in FIG. 3, from which it is obvious that a very even, hardened layer on the outside of the material was formed.

Example 4

A sample substrate based on martensite (1.4057) was placed in an oven and subsequently, in order to remove oxygen, the oven was evacuated to below 100 Pa (1 mbar) and then flooded with an inert gas (nitrogen). After that the specimen was heated to 200° C. by convection at 85 kPa (850 mbar).

In a decomposition reactor (a heatable, metallic heat-resistant tube) attached to the oven 20 vol.-% 2,3,3,3-tetrafluorpropene was cleaved at 950° C. and the decomposition products were introduced into the oven with the aid of 80 vol.-% n argon as a carrier gas and circulated for 45 minutes. The amount of 2,3,3,3-tetrafluorpropene and carrier gas introduced into the decomposition reactor was more than twice the volume of the oven space (calculated at 1013 mbar). After 45 minutes the inflow of the activating gas was ceased and the oven space was again evacuated to below 100 Pa (1 mbar).

After that the oven was flooded with nitrogen as inert gas until 95 kPa (950 mbar) were reached and the sample was heated to 395° C.

The sample was then gassed with a mixture of 95 vol.-% $NH_3$, and 5 vol.-% $CO_2$ for 24 hours at a temperature of 395° C.

After cooling to room temperature under inert atmosphere (nitrogen) the sample was colored grey. The surface hardness according to Vickers of the sample was measured to be 975 HV0.025 and the nitrocarburizing layer thickness in the microsection to be 17 μm (the hardness of the substrate before treatment vas 401 HV0.025).

Figure 4:
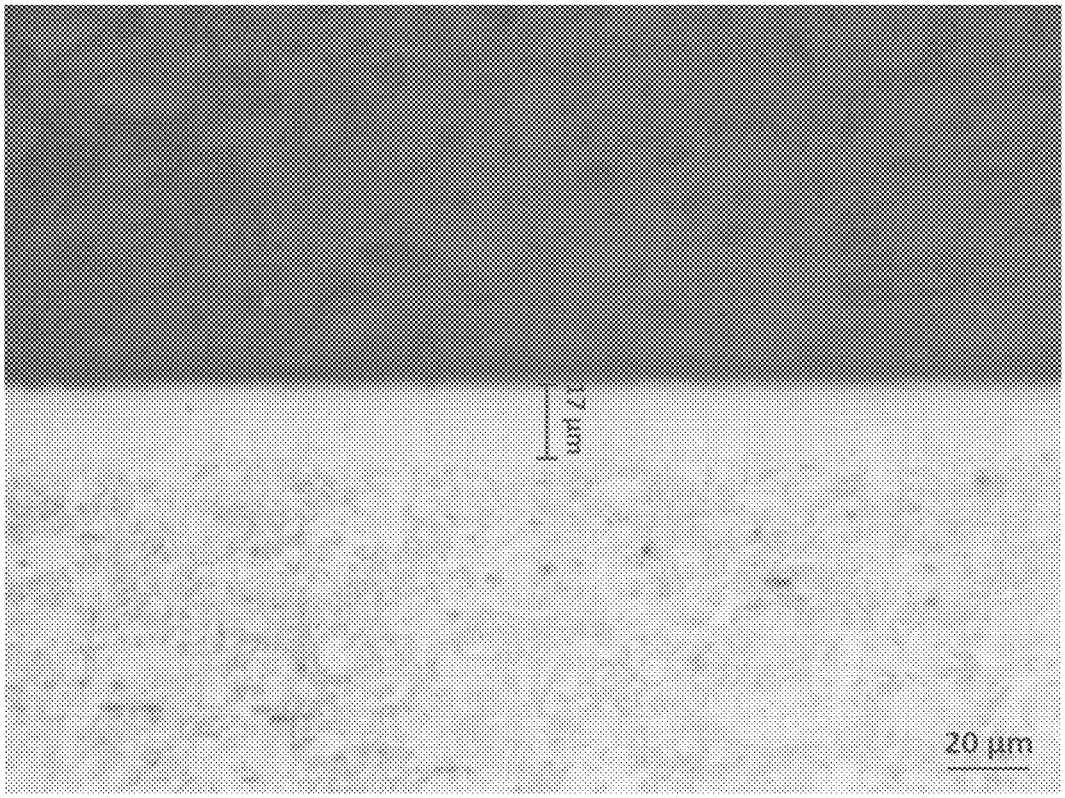
FIG. 4 is a further photograph of a border area of an activated and nitrocarburized sample made from a martensite (1.4057) and activated by the process of the present invention.
Figure 5:
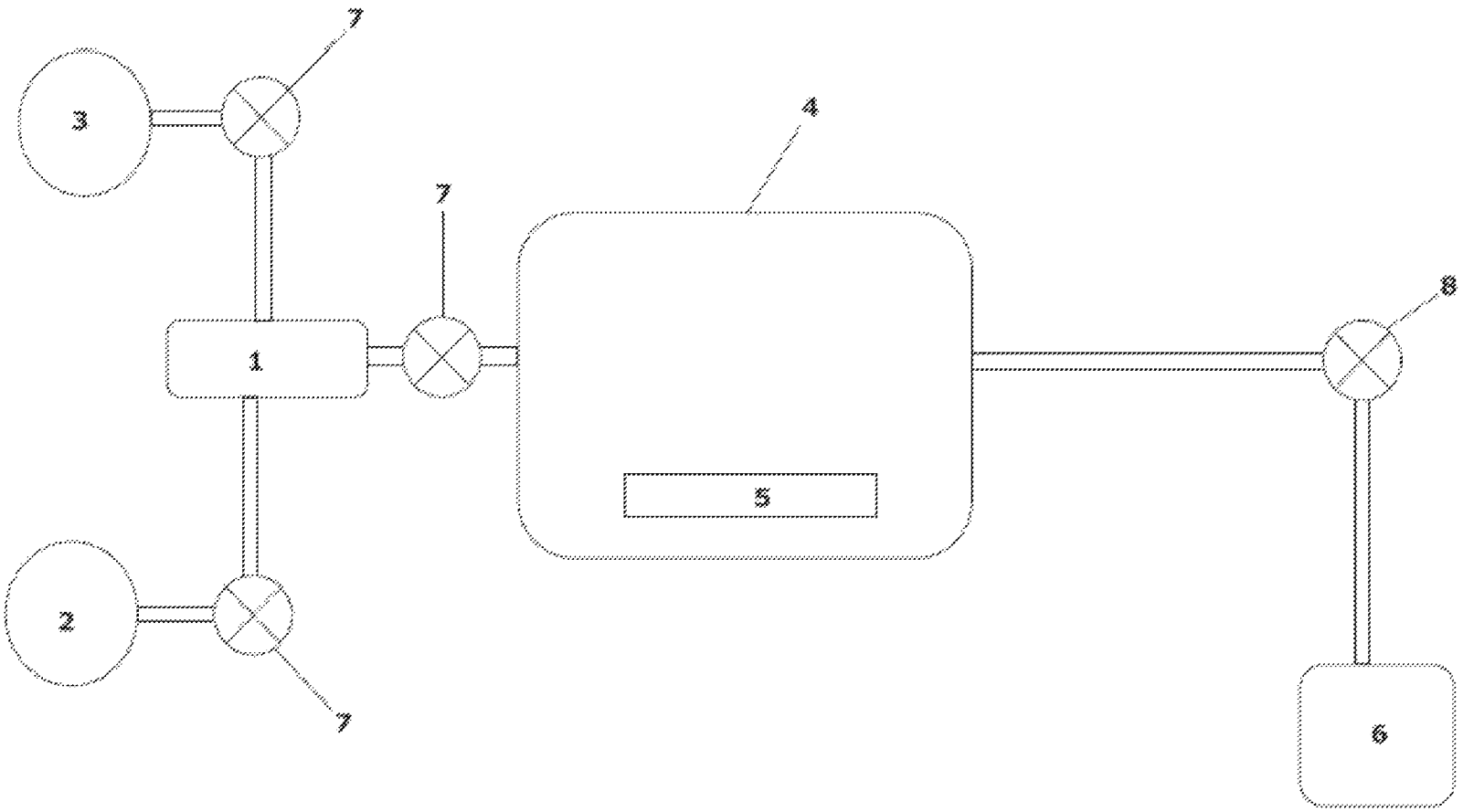
FIG. 5 is a representation of an apparatus in which the process of the present invention is conducted (the respective parts are not drawn to scale and only significant parts of the apparatus are shown; e.g. pumps and heating devices are not shown).

The resulting sample was photographed and is shown in FIG. 4, from which it is obvious that a very even, hardened layer on the outside of the material was formed.

The invention claimed is:

1. A process for pre-treatment of a surface of a chromium containing corrosion resistant metallic substrate prior to further processing, wherein a) the metallic substrate is brought into contact with a thermal decomposition product of a hydrofluoroolefin comprising HF, b) the substrate and the thermal decomposition product are heated, c) and optionally the remains of the thermal decomposition product are partly or entirely removed before further processing, wherein the thermal decomposition product is the thermal decomposition product of tetrafluorpropylene, which may have one or two of its fluorine atoms substituted by chlorine atoms.

2. The process according to claim 1, wherein the heating in step b) is achieved by residual heat of the thermal decomposition product.

3. The process according to claim 1, wherein the substrate is selected from the group consisting of a nickel-based alloy and a cobalt-chromium alloy having at least 10% of solved chromium and alloys of these materials as well as mixed material workpieces.

4. The process according to claim 1, wherein the further processing is a coating process or a diffusion treatment.

5. The method of claim 1 wherein the thermal decomposition product is selected from the group consisting of 2,3,3,3-tetrafluoropropene, 1,3,3,3-tetrafluoropropene, 1-chloro-3,3,3-trifluoropropene and mixtures thereof.

6. The method of claim 1 wherein the thermal decomposition product is 2,3,3,3-tetrafluoropropene or 1,3,3,3-tetrafluoropropene.

7. The method of claim 1 wherein the thermal decomposition product is 2,3,3,3-tetrafluoropropene.

8. The process according to claim 1, wherein the substrate is pre-heated prior to contacting with the thermal decomposition product.

9. The process according to claim 8, wherein the substrate is of the form of martensite, austenite, duplex steel, ferrite, and/or a precipitation hardening steel.

10. The process according to claim 8, wherein the substrate is pre-heated prior to contacting with the thermal decomposition product to a temperature of between 150° C. and 250° C.

11. The process according to claim 8, wherein a holding temperature for the activating step/pre-treatment is in the range of about 150° C. to about 500° C.

12. The method of claim 11 wherein the holding temperature is from about 200° C. to below 400° C.

13. The process according to claim 1, wherein the thermal decomposition process comprises the steps of, in that order, Ia) evacuating a decomposition reactor to below 50 kPa atmospheric pressure, then flushing the reactor with inert gas;

or

Ib) flushing the reactor with inert gas without prior evacuation;

II) supplying a hydrofluoroolefin into the decomposition reactor either neat or together with an inert gas;

III) raising the temperature in the reactor to a decomposition temperature.

14. The process according to claim 13, wherein the decomposition reactor is an oven or a tube and wherein the decomposition reactor is a made of metal and/or ceramic.

15. The process according to claim 13, wherein the decomposition temperature is between 400 to 1200° C.

16. The process according to claim 13, wherein evacuating the decomposition reactor comprises evacuating the decomposition reactor to 10 kPa or less.

17. The process according to claim 13, wherein the inert gas is selected from the group consisting of noble gas, nitrogen, hydrogen, ammonia, carbon dioxide and mixtures thereof.

18. The method of claim 17 wherein the inert gas is selected from argon, nitrogen and mixtures thereof.

* * * * *